US006348906B1

(12) United States Patent
Dawson et al.

(10) Patent No.: US 6,348,906 B1
(45) Date of Patent: Feb. 19, 2002

(54) LINE SCANNING CIRCUIT FOR A DUAL-MODE DISPLAY

(75) Inventors: Robin Mark Adrian Dawson, Princeton; Zilan Shen, Lawrenceville; Alfred Charles Ipri, Princeton; Roger Green Stewart, Neshanic Station; James Harold Atherton, Ringoes; Stephen John Connor, Trenton, all of NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/384,063

(22) Filed: Aug. 26, 1999

Related U.S. Application Data

(60) Provisional application No. 60/099,019, filed on Sep. 3, 1998.

(51) Int. Cl.[7] ..... G09G 3/32

(52) U.S. Cl. ..... 345/82; 345/92; 345/98; 345/100

(58) Field of Search ..... 345/82, 55, 87, 345/94, 98, 99, 100, 206, 208, 90, 92

(56) References Cited

U.S. PATENT DOCUMENTS 5,600,345 A 2/1997 Dingwall et al. ..... 345/100
5,648,790 A 7/1997 Lee ..... 345/58
5,670,979 A * 9/1997 Huq et al. ..... 345/100
5,686,935 A 11/1997 Weisbrod ..... 345/100
5,739,805 A 4/1998 Dingwall ..... 345/100
5,859,630 A * 1/1999 Huq ..... 345/100
5,949,398 A * 9/1999 Kim ..... 345/100
5,952,789 A 9/1999 Stewart et al. ..... 315/169.4

* cited by examiner

*Primary Examiner*—Dennis-Doon Chow
(74) *Attorney, Agent, or Firm*—William J. Burke

(57) ABSTRACT

A row-select circuit for an organic light emitting diode display propagates a gating pulse through a shift register. This gating pulse is synchronized with a system clock signal and is used to selectively apply a plurality of broadcast control signals to a selected row of pixels on the display. The line scanning circuitry is controlled to clear and autozero the pixels in the display either one line at a time or the entire image frame at a time. According to another aspect of the invention, the clearing of a row of pixels in the display is performed over several line intervals before the row is autozeroed and loaded with new values. According to yet another aspect of the invention, the broadcast control signals may be adapted to achieve the best performance for each display device.

11 Claims, 6 Drawing Sheets

LINE SCANNING CIRCUIT FOR A DUAL-MODE DISPLAY

This applications claims the benefit of U.S. provisional application No. 60/099,019 filed Sep. 3, 1998, which is incorporated herein by reference.

This invention was made with Government support under Contract No. F33615-96-2-1944 awarded by the Department of the Air Force. The Government has certain rights in this invention.

BACKGROUND OF THE INVENTION

The present invention concerns video display devices and in particular an active matrix organic light-emitting diode display which can operate either by clearing the pixels of the display device one row at a time or by clearing all of the pixels in the pixel array in a single operation.

An active matrix display device is one in which image data is stored in each picture element (pixel) of the display and the image is illuminated for a substantial part of the frame interval. There are two basic active-matrix display architectures. The first is a "row at a time" architecture where the image is updated one line at a time, as it is being displayed. In this architecture, a single row of the pixels is cleared and set-up to receive new data values and then a new line of data is written into the cleared pixels. The process repeats continually with each line of the image being updated at least once in a frame interval.

The second type of display architecture clears and sets-up the entire image in a single operation and then quickly writes new image data into all of the pixels one line at a time. This type of display operates in four distinct intervals: clear, set-up, write and illuminate. A display architecture of this type is particularly appropriate for use with a color shutter or other device where the entire pixel array is turned off for some fraction of the frame time.

Organic light emitting diode (OLED) displays are formed from a matrix of OLED devices. These devices emit light in response to an electric current. The intensity of the light is a function of the amplitude of the current. U.S. patent application Ser. No. 09/064,696 entitled ACTIVE MATRIX ORGANIC LIGHT EMITTING DIODE PIXEL STRUCTURES describes an exemplary OLED color matrix display device which controls the current through each OLED pixel by storing a voltage on a capacitor in the pixel cell. As described in this patent, each OLED device is discharged, autozeroed (i.e. set-up to receive new data) and then loaded with the new data.

As the number of pixels in a display increases, both the horizontal and vertical scan rates also increase so that the sequence of images can be displayed at a constant frame rate. As the horizontal scan rate increases, less time is available to update each row of pixels in the display. Existing row-at-a-time architectures are not well suited for high resolution OLED displays because it is difficult to discharge, autozero and load a row of pixel data in one line time at the scan rate of, for example, a high-definition television receiver.

SUMMARY OF THE INVENTION

The present invention is embodied in a row select circuit for an organic light emitting diode display. The row select circuit propagates a gating pulse through the shift register. This gating pulse is synchronized with a system clock signal and is used to apply a plurality of broadcast control signals, to sequentially selected rows of pixels on the display.

According to one aspect of the invention, the line scanning circuitry is controlled to clear and autozero the pixels in the display either one line at a time or the entire image array may be autozeroed concurrently.

According to another aspect of the invention, the clearing and autozeroing of a row of pixels in the display may be performed over several line intervals before the row is loaded with new values. This overcomes the problem of reduced scan time available in high resolution displays.

According to yet another aspect of the invention, the broadcast control signals may be adapted to achieve the best performance for each display device.

DETAILED DESCRIPTION OF THE EXEMPLARY EMBODIMENTS

Figure 1:
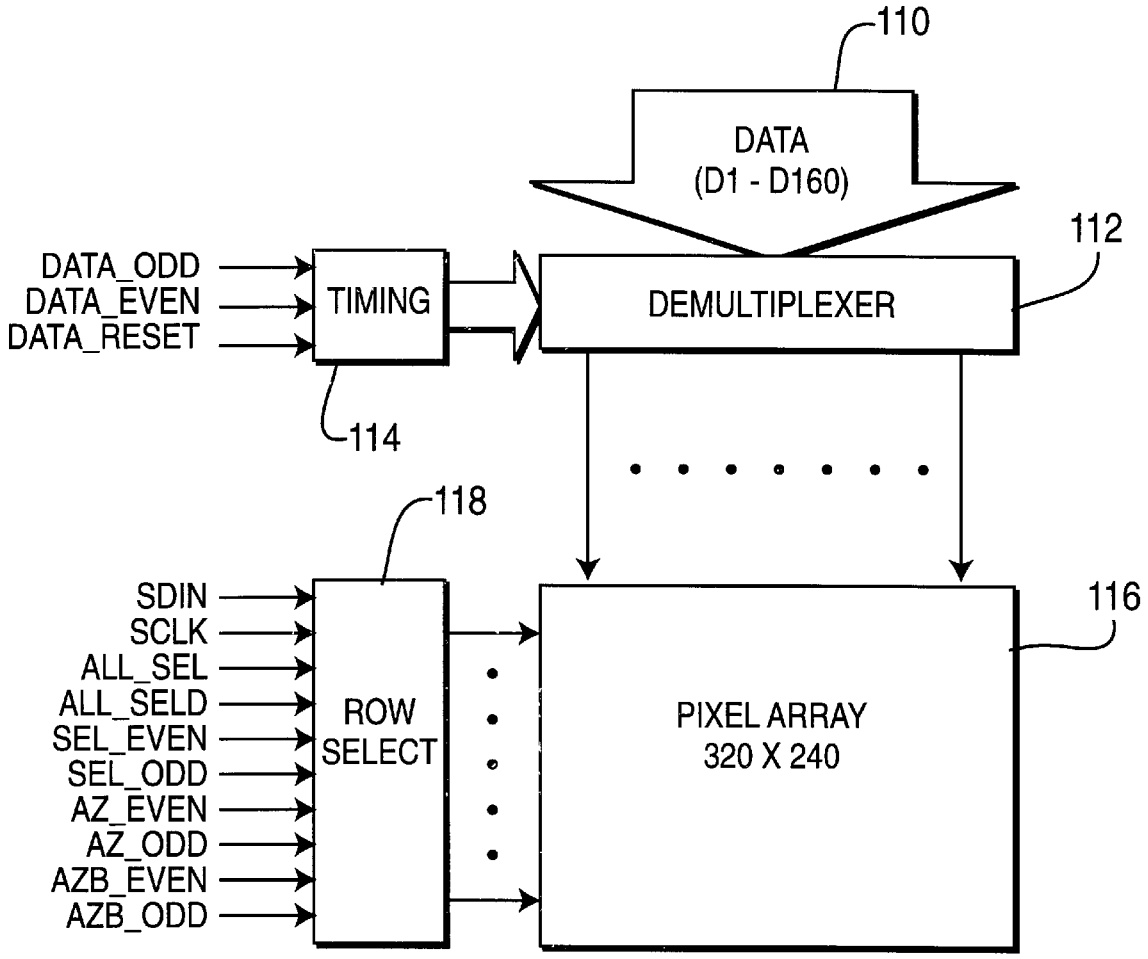
FIG. 1 is a block diagram of a organic light emitting diode (OLED) matrix display device which includes an embodiment of the invention.

FIG. 1 is a block diagram of an OLED matrix display device which includes an embodiment of the invention. Although the exemplary embodiments of the invention are described with reference to an OLED display device, it is contemplated that they may be practiced with other types of display devices, for example liquid crystal device (LCD), electroluminescent or plasma panel display devices that are operated either in a line-at-a-time mode or an array autozero mode.

The display shown in FIG. 1 is implemented in a polysilicon technology directly on the active matrix display device 116. Exemplary technology for implementing circuits such as the demultiplexing circuitry 112 and row select circuitry in polysilicon is disclosed in U.S. Pat. No. 5,633,635 entitled SIMULTANEOUS SAMPLING OF DEMULTIPLEXED DATA AND DRIVING OF AN LCD PIXEL ARRAY WITH PING-PONG EFFECT. The present invention is implemented using a single channel PMOS process. It is contemplated, however, that the functions described below may be implemented in a single channel NMOS process, in a CMOS process or any other transistor technology.

FIG. 1 shows a display device which includes a plurality of pixels arranged in a matrix having, for example, 320 columns by 240 rows. The display also includes column data generators 110 which provide picture data values to a demultiplexer 112. The exemplary data generator 110 may, for example, include a multiport digital to analog converter such as the CL-FP6502 integrated circuit available from Cirrus Logic. The demultiplexer 112, responsive to timing signals provided by a timing circuit 114, demultiplexes the data values provided by the generators 110 to provide data for all of the pixels in a row of the display 116. In the exemplary embodiment of the invention, the input signals to the timing circuit 114 are DATA_ODD, DATA_EVEN and DATA_RESET. The signals DATA_ODD and DATA_EVEN are active when data values provided by the demultiplexer 112 are to be written into respective odd and even numbered rows of the display 116. When DATA_RESET is active, null image data (e.g. logic-high values) are applied to the column drivers (not shown) of the display 116.

The image data are updated line-by-line as each row of the display device is selected by the row select circuitry 118. The row select circuitry 118 may be considered to be a shift register which sequentially selects each row of the display 116 and applies a sequence of control signals to all of the pixels in the row. The structure and operation of the row select circuit 118 are described below with reference to FIGS. 3 and 4. The structure and operation of an individual pixel of the display 116 are described below with reference to FIG. 2. As described below, when the data to be displayed at a particular pixel position changes, the corresponding pixel is first reset, then subject to an autozero operation, the data is written into the pixel and the pixel is illuminated. After the new display data is written and until the display data in that pixel is to be updated again, the pixel is turned on so that it may be illuminated at a level corresponding to the display data that was written into the pixel.

As described above, the exemplary display device operates in two modes: line-at-a-time mode in which each row of pixels is reset, autozeroed and rewritten row by row and frame at a time mode in which all of the pixels in the pixel array 116 are concurrently reset and autozeroed and then display data is written into the reset and autozeroed pixel elements row by row. The input signals to the row select circuit control these operations. These signals include SDIN, a pulse signal which begins the scanning operation; SCLK, the system clock signal; ALL_SEL and ALL_SELD, which control the selection of the entire display during the reset and autozero operations in array autozero mode; SEL_EVEN and SEL_ODD which control when respective even and odd rows of the pixel array 116 are selected.; and AZ_EVEN, AZ_ODD, AZB_EVEN and AZB_ODD which control the autozero and illuminate operations as described below with reference to FIG. 2.

Figure 2:
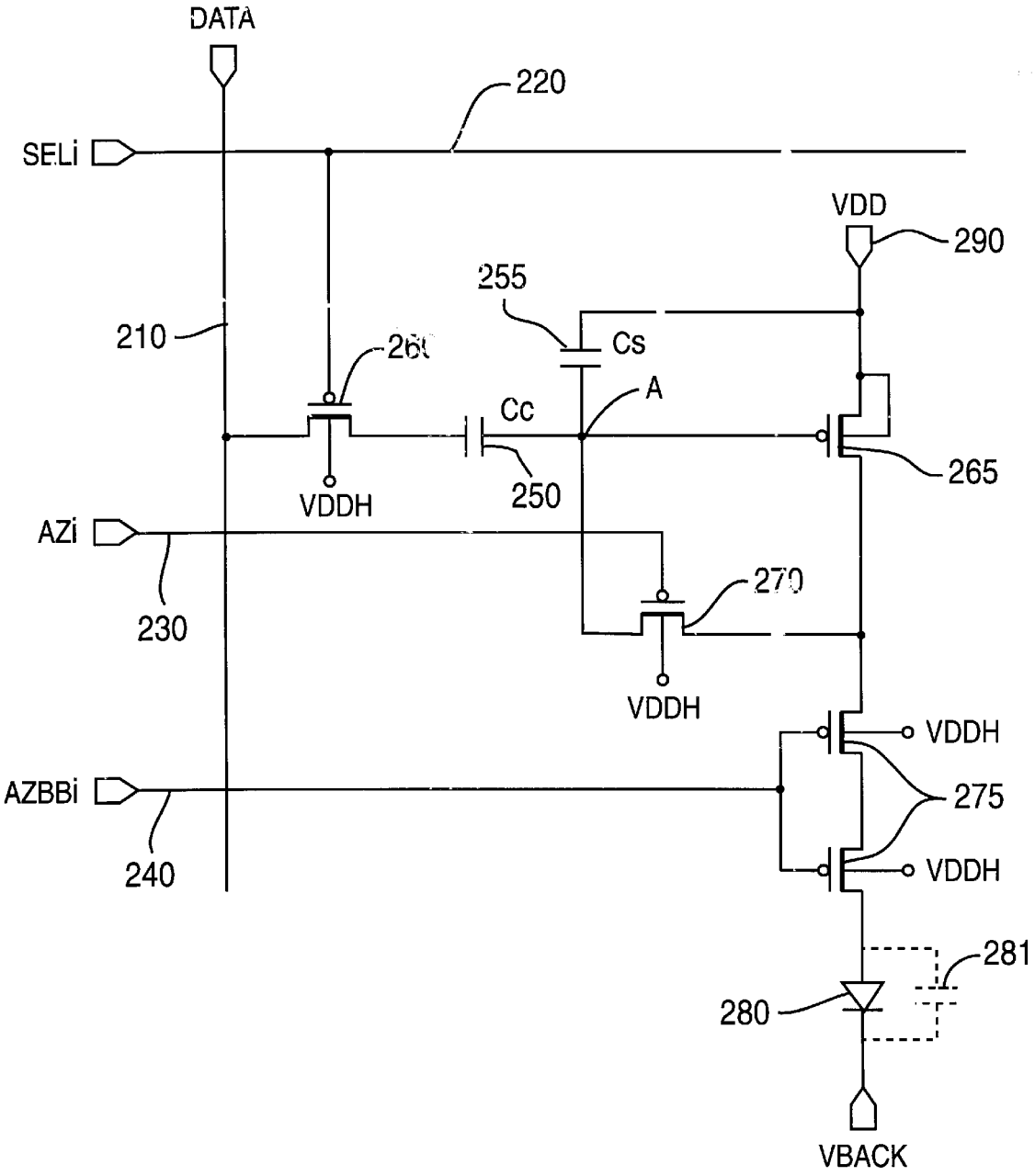
FIG. 2 is a schematic diagram of an OLED pixel structure suitable for use in the display device shown in FIG. 1.

Referring to FIG. 2, the exemplary pixel structure 200 comprises five PMOS transistors (260, 265, 270, and a pair of transistors 275), two capacitors 250 and 255 and a LED (OLED) 280. The transistors 275 are configured to have series-connected channels and parallel connected gates to limit the leakage current which may flow from the pixel circuitry into the OLED 280 during the autozero and data load phases. A select (SELi) line 220 is coupled to the gate electrode of transistor 260. A DATA signal 210 is coupled to the source electrode of transistor 260. An operational power signal 290 which provides a positive potential, VDD (e.g. +5 V), is coupled to the source electrode of transistor 265 and to one terminal of capacitor 255. An auto-zero (AZi) line 230 is coupled to the gate electrode of transistor 270 and an illuminate (AZBBi) line is coupled to the interconnected gate electrodes of transistors 275. The cathode electrode of the OLED 280 is coupled to the drain electrode of one of the transistors 275 and the anode electrode of the OLED 280 is coupled to a source of negative potential, VBACK (e.g. −15 V). The OLED 280 has a diode capacitance 281 (shown in phantom) which is inherent in the device. The source electrode of the other one of the transistors 275 is coupled to the connected drain electrodes of transistors 265 and 270. The drain electrode of transistor 260 is coupled to one terminal of capacitor 250. Finally, the gate electrode of transistor 265, the source electrode of transistor 270, one terminal of the capacitor 250 and one terminal of the capacitor 255 are all coupled together at a node designated node A.

Figure 3:
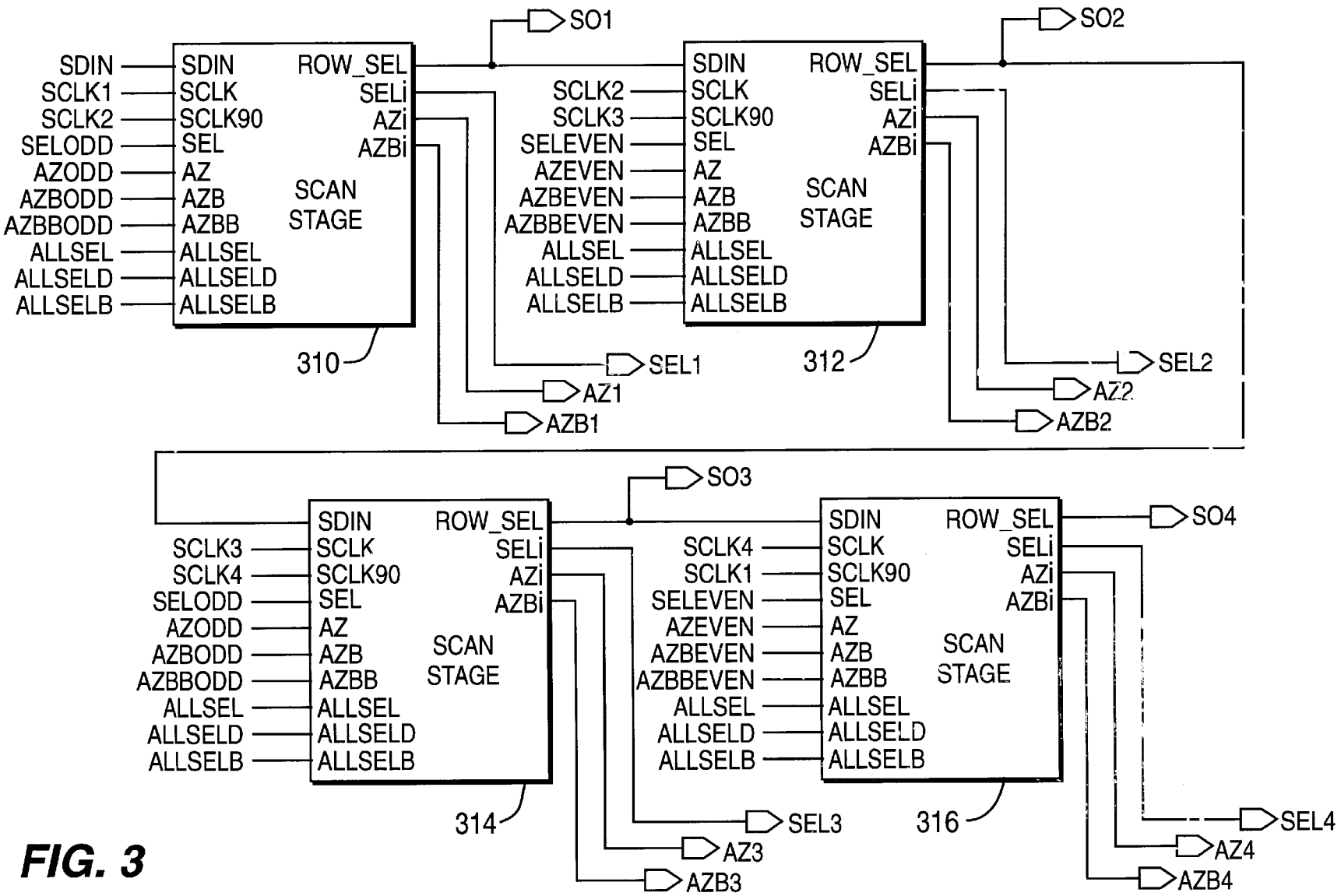
FIG. 3 is a block diagram of a segment of a row select circuit which may be used in the display device shown in FIG. 1.

More specifically, FIG. 3 illustrates a pixel structure 200 that is operated in four phases: 1) a reset phase, 2) an auto-zero phase, 3) a load data phase and 4) an illuminate phase.

In the reset phase, a data value has been stored at node A, the AZi signal 230 is at a logic-high level and the AZBBi signal 240 is at a logic-low level. The data signal 210 is brought to a logic-high level and the SELi signal 220 is pulsed while the data signal is logic-high. This step turns on transistor 260 causing it to turn off transistor 265 while leaving a conductive path from the drain electrode of transistor 265 to the cathode electrode of OLED 280. This operation allows the OLED 280 to discharge its internal capacitance 281, preparing it to be illuminated at a different level. In the exemplary embodiment of the invention described below with reference to FIG. 5, the reset phase occurs in the line interval immediately before the line interval in which the autozero and data load phases occur. This is achieved by selecting each row of pixels for at least a portion of two line intervals, resetting the row during the first line interval and performing the autozero and data load operations during the second line interval.

For some display types, for example high-definition television displays, more time may be needed to completely discharge the capacitance 281 of the OLED 280 than is provided in the exemplary embodiment of the invention. For these display types, the interval in which an individual row of pixels is selected may be extended to, for example, three or ten line intervals and, during each of these line intervals, the pixels in the row may be reset by concurrently pulsing the DATA_RESET signal and the select signals SEL_EVEN and SEL_ODD.

Returning to FIG. 3, in the auto-zero phase, the AZi signal 220 and the AZBBi signal 240 are set to logic-low, turning on the two transistors 275 and the transistor 270. In this configuration, the potential at the drain electrode of transistor 265 is coupled to the gate electrode of the transistor. The DATA signal 210 is maintained at a logic-high level.

Next, the AZBBi signal 240 is set to logic-high, so that the transistors 275 are turned off. The gate to source potential across transistor 265, as stored on capacitor 255, then settles to the turn-on threshold voltage of transistor 265. This operation stores the turn-on threshold voltage across capacitor 255 and stores the difference between the logic-high potential and the threshold voltage on capacitor 250. The potential stored on capacitor 255 represents a fixed overdrive voltage for transistor 265 regardless of any variation in threshold voltage that may occur due to age or operation. The last step in the auto-zero operation is to set the AZi signal to a logic-high value which isolates the gate electrode of transistor 265. This operation can be repeated over multiple row times in a fashion similar to the reset operation.

At the end of the Auto Zero phase, the SELi signal 220 is held at a logic-low value and the DATA signal 210 is still at the logic-high level. The load data phase begins when a data voltage is applied to the source electrode of transistor 260 via the DATA signal 210. This change in the DATA signal is coupled through capacitor 250 onto the gate electrode of transistor 265 and, so, changes the potential stored across capacitor 255. The change in the charge of capacitor 255 is proportional to the change in the DATA signal 210 from the logic-high value to the programmed data voltage value. Because this data voltage change is made with reference to the threshold potential of transistor 265, the change in the DATA signal 210 is translated into a gate to source voltage for the transistor 265 which causes the transistor 265 to provide a predetermined current to the OLED 280. Next, the SELi signal 220 is set to a logic-high value. Turning off transistor 260 but leaving the programmed gate to source current across capacitor 255.

With the data voltage stored on the capacitor 255, the AZBBi signal 240 is set to a logic-low value turning on the transistors 275 to allow the predetermined current provided by the transistor 265 to flow through the OLED 280. This predetermined current causes the OLED 280 to glow at a predetermined level of illumination. The illumination phase continues for the remainder of the frame interval until it is time to store new image data into the pixel. Then the reset, autozero, load data and illuminate phases are repeated.

Figure 5:
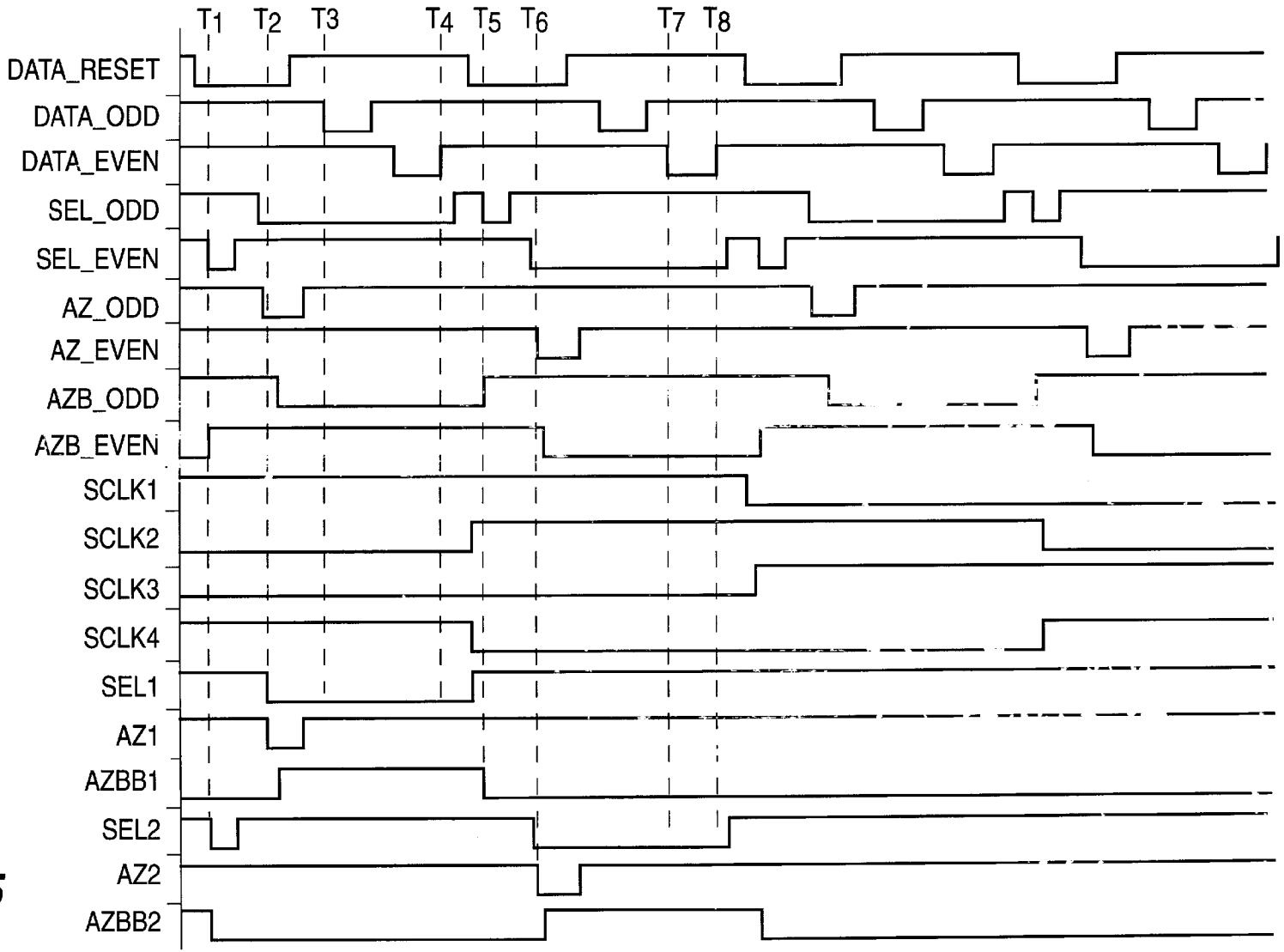
FIG. 5 is a timing diagram which is useful for describing the line-at-a-time scanning mode for the row select circuit shown in FIGS. 3 and 4.

As described above, with reference to FIG. 1, the signals SELi, AZi and AZBBi are provided to a particular row i of the display 116 by a row select circuit 118. The row select circuit includes one stage for each row in the display 116. The row select circuit is controlled in synchronism with a four phase clock signal that is derived from the signal SCLK shown in FIG. 1. The exemplary timing diagram shown in FIG. 5 illustrates the relationship among all of the signals shown in FIG. 1 and also shows the four phases (SCLK1, SCLK2, SCLK3 and SCLK4) of the clock signal SCLK.

FIG. 3 is a block diagram of a portion of a line-scanning circuit which may be used as the row select circuit 118, shown in FIG. 1. The portion shown in FIG. 3 includes only four stages. A complete row select circuit may be formed by cascading multiple circuits such as that shown in FIG. 3 until the number of stages equals the number of lines in the display 116. An exemplary stage of the row select circuit 118 is described below with reference to FIG. 4.

As shown in FIG. 3, the stages of the row select circuit 118 alternate between odd and even rows with the odd stages receiving the odd signals SEL_ODD, AZ_ODD, AZB_ODD and AZBB_ODD, while the even stages receive the corresponding even signals SEL_EVEN, AZ_EVEN, AZB_EVEN and AZBB_EVEN. All of the stages receive the signals ALL_SEL, ALL_SELD and ALL_SELB. Each stage also receives two clock signals. The first stage 310 receives the signals SCLK1 and SCLK2, the second stage 312 receives the signals SCLK2 and SCLK3, the third stage 314 receives the signals SCLK3 and SCLK4, and the fourth stage 316 receives the signals SCLK4 and SCLK1. This configuration repeats with each of the cascaded circuits such that, if there were a fifth stage after stage 316, it would receive the signals SCLK1 and SCLK2. As described below with reference to FIG. 4, the first clock signal is referred to as SCLK and the second clock signal, which is delayed in phase by 90° with respect to the first clock signal, is referred to as SCLK90.

The first stage of the row select circuit receives a pulse signal SDIN which starts the scanning operation. Typically, the first stage of the row select circuit 116, shown in FIG. 1, receives a pulse of the signal SDIN at the start of each frame or field. The exemplary display device may display single frames or interlaced fields by virtue of the odd and even select signals.

One output signal of each stage is the signal ROW_SEL which, as described below, controls the gating of the other signals, SELi, AZi and AZBBi to the display row i. The signal ROW_SEL conforms to a single pulse of the second clock signal applied to the stage. This pulse occurs once per frame interval unless multiple pulses are required for reset and autozero. The ROW_SEL output signal of each stage is applied to the SDIN input terminal of the next successive stage to propagate the row selection signal through all of the stages of the row select circuit 118.

Figure 4:
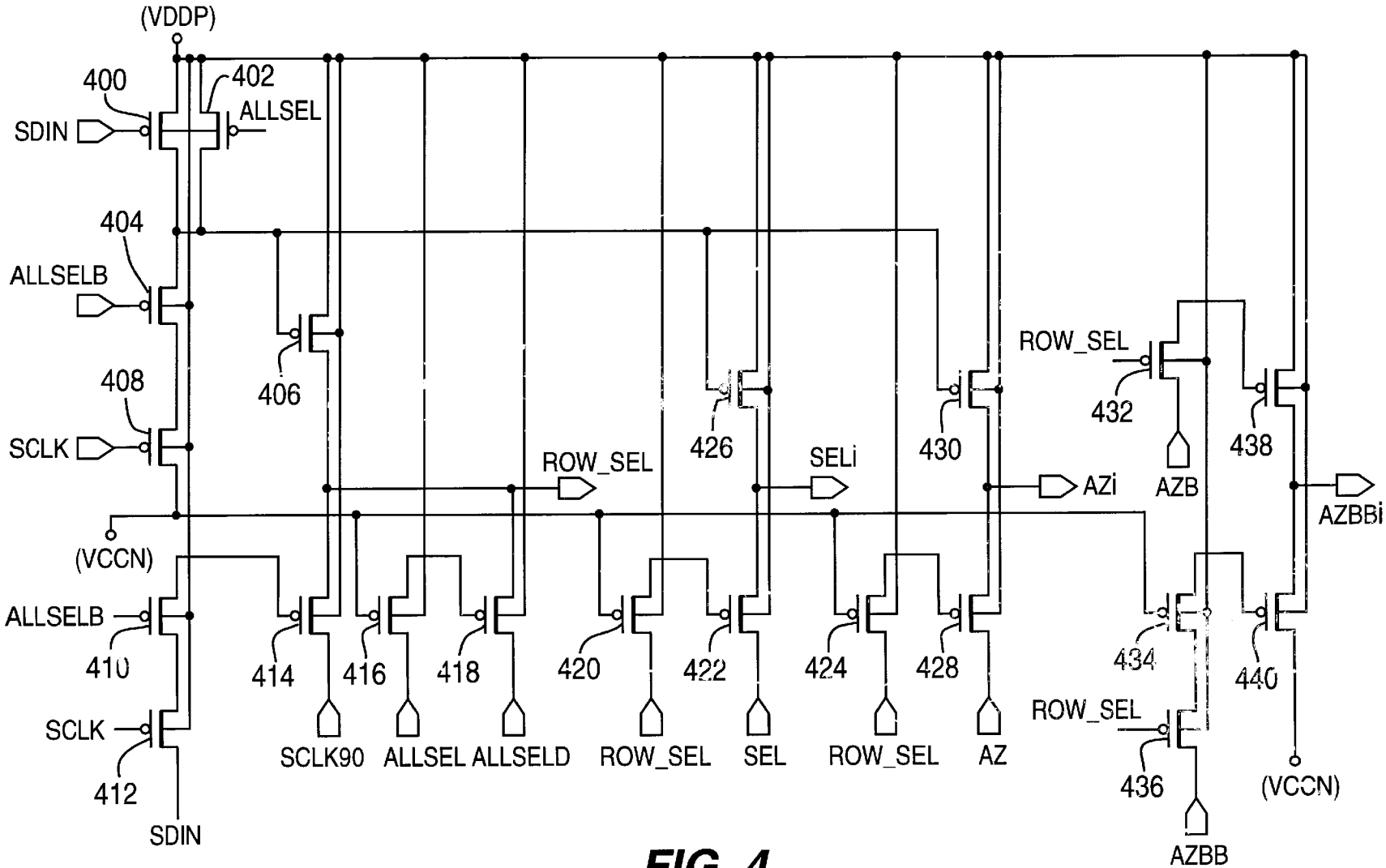
FIG. 4 is a schematic diagram of one of the stages of the row select circuit shown in FIG. 3.

The circuit shown in FIG. 4 is a single stage of the row select circuit shown in FIG. 3. At a basic level, the circuit shown in FIG. 4 is a shift register which propagates a gating signal (SDIN) from stage to stage. When the select signal propagates to a stage, that stage applies the broadcast control signals to a particular row. The function of the control signals is described above with reference to FIGS. 2 and 3. The timing of the control signals is described below with reference to the timing diagrams shown in FIGS. 5 and 6.

As described above, the circuitry shown in FIG. 4 operates in two modes: a line-at-a-time mode and an array autozero mode. The signals ALL_SEL, ALL_SELB and ALL_SELD control the circuit when it is operating in the array autozero mode. When the circuit operates in the line-at-a-time mode, the signals ALL_SEL and ALL_SELD are held at logic-high values while the signal ALL_SELB (the logical inverse of the signal ALL_SEL) is held at a logic-low value. The materials that follow describe the operation of the circuit first in the line-at-a-time mode and then in array autozero mode.

The signal SDIN is the gating signal which selects the row controlled by the circuitry shown in FIG. 4. The signal SDIN may be considered to be a trigger signal which enables the circuit to propagate the control signals while the signal SCLK90 is in a logic-low state. Until the signal SDIN is applied to the stage, both transistors 400 and 402 are turned off. Periodic pulses of the signal SCLK turn on transistor 408 applying a logic-low potential VCCN (e.g. −15 V) to the gate electrodes of transistors 406, 426 and 430. These transistors, in turn, apply a logic-high potential VDDP (e.g. +5V) as the output signals of the stage, ROW_SEL, SELi and AZi.

As described above, the signal SDIN is the ROW_SEL signal from the previous stage. In the exemplary embodiment of the invention, the signal SDIN is active at the same time as the signal SCLK when the stage is selected. Consequently, when SDIN is active, both transistors 400 and 408 are turned on. Transistor 404 is always turned on when the display device is operated in line-at-a-time mode because the signal ALL_SELB is logic-low in line-at-a-time mode. As transistors 408, 404 and 400 are all turned on when the signal SDIN is active, the signal applied to the gate electrodes of the transistors 406, 426 and 430 is brought to a logic-high level due to the voltage divider created by the channel resistances of the transistors 406, 426 and 430. The logic-high level on the gate electrodes of transistors 406, 426 and 429 turns these transistors off.

In addition, when the signal SCLK becomes active, the signal SDIN propagates through transistors 412 and 410 to the gate electrode of transistor 414. This signal turns on transistor 414 allowing the signal SCLK90 to propagate through transistor 414 as the row select signal ROW_SEL for this stage.

When SCLK90 becomes logic-low, a logic-low signal ROW_SEL is applied to the source electrodes of transistors 420 and 424, and to the gate electrodes of transistors 432 and 436. The transistors 420 and 424 are always turned on because their gate electrodes are coupled to the VCCN supply. When the signal ROW_SEL becomes logic-low, transistors 420 and 424 apply the logic-low signal to the gate electrodes of transistors 422 and 428, respectively, causing these transistors to turn on and pass the broadcast select signals SEL as the signal SELi, and the broadcast autozero signal, AZ, as the autozero signal AZi for the display row i to which the select stage shown in FIG. 4 is attached.

Also when the signal ROW_SEL becomes logic-low, transistors 432 and 436 become conductive. Transistor 432 then applies the signal AZB to the gate electrode of transistor 438 and transistor 436 applies the signal AZBB, through transistor 434, which is always turned on because its gate electrode is connected to the negative supply VCCN, to the gate electrode of transistor 440. As described above, the signals AZBB is generated by inverting the signal AZB. The output signal, AZBBi of the transistors 438 and 440 is logic-high while the signal AZB is in a logic-low state and is logic-low while the signal AZBB is in a logic-low state. This signal is applied to the AZBBi input terminal of each pixel in the selected row, as described above, to allow the capacitance 281 inherent in the OLED 280 to discharge, to block the OLED while the pixel is being programmed and to illuminate the OLED 280 when the row is not selected.

In array autozero mode, the circuit shown in FIG. 4 clears and autozeros all of the pixels in the display device in a first part of the frame interval, stores data into the pixels on a row-by-row basis during a second part of the frame interval and illuminates the display in a third part of the frame interval. When the select circuit shown in FIG. 4 operates in array autozero mode, the signals ALL_SEL and ALL_SELD control the select stage as described below with reference to FIG. 6. The signal ALL_SELB is the inverse of the signal ALL_SEL. In array autozero mode, the signal SDIN is held at a logic-high value during the reset, autozero and illuminate phases but is used to select the successive rows of pixels during the data load phase.

In the circuit shown in FIG. 4, when the signal ALL_SEL becomes logic-low, transistor 402 is turned on which applies the positive potential VDDP to the gate electrodes of transistors 406, 426 and 430, turning those transistors off. The logic-low ALL_SEL signal is transmitted through transistor 416 to turn on transistor 418 which applies the signal ALL_SELD as the signal ROW_SEL. As described above, the signal ROW_SEL allows the signals SEL, AZ, and AZBB to be propagated to the row of the display that is connected to the select stage. Because the signal ALL_SEL is applied to all of the stages of the select circuit, these signals are simultaneously applied to all of the rows of the display device, clearing and autozeroing every pixel in the display. When the signal ALL_SEL becomes logic-high, the reset and autozero functions have been performed. Next, the signals ALL_SEL and ALL_SELD are deactivated (i.e. brought to a logic-high level) and a single pulse signal is applied, as the signal SDIN, to the first stage of the select circuitry. This begins the scanning the rows of pixels in the display device as described above with reference to the line-at-a-time mode. In the array autozero mode, however, only the SCLK, SCLK90 and SEL signals are gated through the select stage when the row is selected the signal Azi remains at a logic-high level. In this stage, data values are written into the pixels. After the data values have been written, the signal AZBB is held logic-low to illuminate the display. Because only the data load phase is performed in the array autozero mode when an individual line of pixels is selected, the duration of the select signal may be much less than in the line-at-a-time mode.

The transistor pairs 416, 418; 420, 422; 424, 428 are in a bootstrap configuration that allows the respective signals ALL_SELD, SEL and AZ and AZBB to be provided to the selected row over their entire range. The operation of this bootstrap configuration is described with reference to the transistor pair 420 and 422. It is equally applicable to the transistor pairs 416, 418; 424, 428 and 434, 430. As described above, the gate electrode of transistor 420 is coupled to the negative potential VCCN and, so, the transistor is turned on as long as the potential applied to the source electrode of the transistor is more than one threshold voltage greater than VCCN. In the exemplary embodiment of the invention, when the signal ROW_SEL first transitions to logic-low, the potential at the drain electrode of transistor 420 decreases until it reaches one threshold voltage above VCCN. At this point, the transistor 420 is no longer conductive and the gate electrode of transistor 422 is floating at the potential of VCCN plus one threshold. This potential turns transistor 422 on. When the signal SEL becomes logic-low, after transistor 420 has turned off, the transition from logic-high to logic-low is capacitively coupled from the channel of transistor 422 to the gate electrode, bringing the gate electrode to a level less than one threshold above VCCN. This causes transistor 422 to remain conductive even when the signal on the source electrode of transistor 422 is at the VCCN level.

FIG. 5 is a timing diagram which illustrates the operation of the row select circuitry when the display device shown in FIG. 1 is operated in line-at-a-time mode. The left side of the timing diagram is at the positive-going transition 510 of the signal SCLK1. At this instant, the clock phase SCLK1 has been at logic-zero for one half of a cycle and the first stage of the select circuit shown in FIG. 3 has been reset. The first event shown in FIG. 5 is the negative going pulse of the signal SEL2 at time T1. This pulse occurs because the signal SDIN has propagated to circuit 312 of FIG. 3 and the signal SEL_EVEN has a negative pulse when SCLK3, (SCLK90 of stage 312) is logic-low. The signal DATA_RESET is also active at time T1 causing all of the pixels in the second row of the display 116 to be reset.

Next, at time T2, the autozero operation begins for the first stage 310 of the row select circuit shown in FIG. 3. The AZ1 pulse occurs at time T2 because stage 310 is still selected and the signal SCLK2 (SCLK90 of stage 310) is logic-low when a negative pulse of the signal AZ_ODD occurs. Next, between times T3 and T4, new display data is stored into the pixels of row 1. This occurs because stage 310 is still selected and the DATA_ODD and DATA_EVEN are sequentially activated while the signal SCLK2 (SCLK90 of stage 310) is logic-low. At time T5, the signal SCLK2 is in a logic-high level, deselecting stage 310 and the signal AZZB1 transitions to logic-low, beginning the illumination phase of row 1. At the same time, row 3 is reset because the signal SDIN (i.e. one pulse of the signal SCLK3) has propagated to stage 314 and a negative pulse of the signal SEL_ODD occurs when SCLK4 (SCLK90 of stage 314) is logic-low. At time T6, the pixels in row 2 are autozeroed because a negative-going pulse of the signal AZ_EVEN occurs while SCLK3 is logic-low. Between times T7 and T8, the data values are stored into the pixels of row 2 by activating DATA_ODD and DATA_EVEN when SCLK3 is logic-low. Note that both DATA_ODD and DATA_EVEN are activated in one row time.

Figure 6:
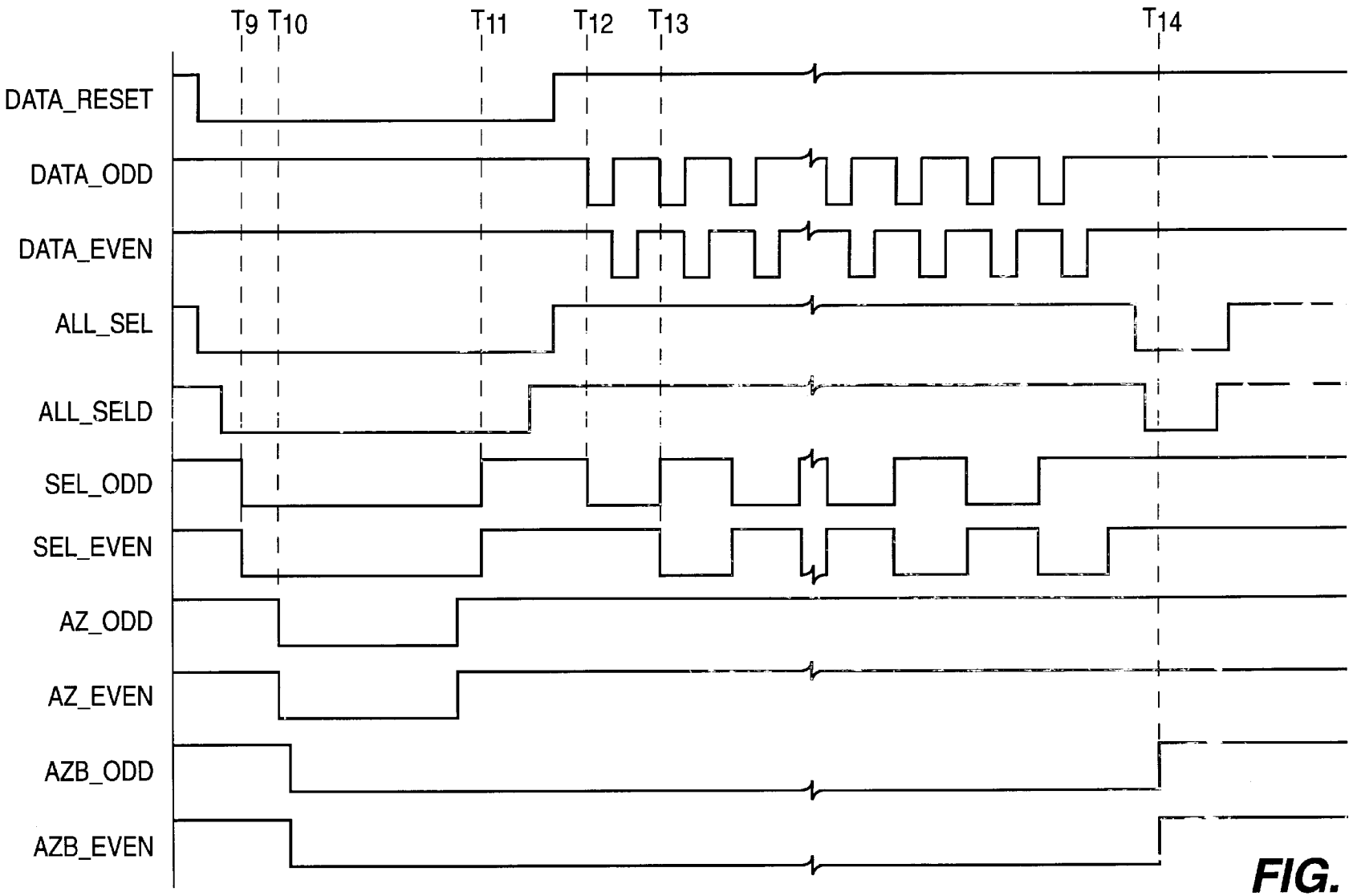
FIG. 6 is a timing diagram which is useful for describing the array autozero mode for the row select shown in FIGS. 3 and 4.

FIG. 5 shows the interaction of the signals that control the display device when the device is operated in line-at-a-time mode. FIG. 6 shows the signals DATA_RESET, DATA_ODD, DATA_EVEN, ALL_SEL, ALL_SELD, SEL_ODD, SEL_EVEN, AZ_ODD, AZ_EVEN, AZB_ODD and AZB_EVEN when the display device 116 is operated in array autozero mode. When the display device shown in FIG. 1 is operated with the signals shown in FIG. 6, all of the pixels in the display 116 are reset and autozeroed concurrently. Next, data is loaded into the individual lines of the display one row at a time. Finally, when all of the rows have been loaded, the entire display is illuminated.

At time T9, the SEL_ODD and SEL_EVEN signals are both activated while ALL_SEL and ALL_SELD are active. This causes all of the pixel rows to be selected. At the same time, the signal DATA_RESET is active, bringing all of the data lines to logic-high levels. Thus, the reset operation begins for the entire array at time T9. At time T10, the signals AZ_ODD and AZ_EVEN are activated beginning the autozero operation for the entire pixel array. Shortly after Time T10, the signals AZB_ODD and AZB_EVEN become logic-low and, so, their inverted signals AZBB_ODD and AZBB_EVEN become logic-high, disconnecting the OLEDs 280 from the respective pixel circuits. The autozero operation ends at time T11 when AZ_ODD, AZ_EVEN, SEL_ODD and SEL_EVEN are all at a logic-high level. By time T12, DATA_RESET, ALL_SEL and ALL_SELD have been reset to logic-high levels and a pulse of the signal SDIN (not shown) has been applied to the row select circuit 118. This pulse begins the normal scan mode but, because all of the pixels have been reset and autozeroed, the clock signals, SCLK, applied to the circuit 118 may be at a higher rate than is used in line-at-a-time mode.

At time T12, DATA_ODD and DATA_EVEN sequentially become logic-low, loading data into the first row of the pixel array 116. At time T13, the signal DATA_EVEN becomes logic-low gating data into the second row of the pixel array. This continues until all of the rows have been loaded. At time T14, the signals AZB_ODD and AZB_EVEN transition to logic-high and their respective inverse signals AZBB_ODD and AZBB_EVEN transition to logic-low, starting the illumination phase of the display.

The exemplary row select circuitry 118 described above is implemented on the surface of the display device 1 16 which includes polysilicon areas that are used to form the transistors in the pixel cell. The operation of polysilicon transistors may vary widely from one panel to the next within a given panel and in any given panel over time. The exemplary row select circuitry 118 described above is particularly adapted for use with polysilicon displays. The circuitry allows the current source transistor in each pixel to be autozeroed before each data load phase to ensure consistent performance even when the gate to source threshold voltage of the transistor changes. Because these control pulses are broadcast and gated to the rows by the select signals, the pulse widths of the broadcast control pulses may be varied from display to display in order to achieve optimum performance. For example, as described above, the select pulses may be extended to select any given row for three or more line intervals in order to allow more time for the OLED device to dissipate its internal charge. In addition, the width of the autozero pulses may be crafted to compensate for mobility variations in the transistors of a given display device as compared to other display devices.

While the present invention has been described in terms of exemplary embodiments, it is contemplated that it may be practiced as described above within the scope of the appended claims.

What is claimed is:

1. A row select circuit for a display device having rows of picture elements (pixels), the row select circuit comprising:

a plurality of broadcast control signals;

a plurality of stages connected in series, each stage being coupled to a respective one of the rows of pixels and being coupled to receive a select signal from the previous stage wherein the first stage is coupled to receive a select signal at the start of an image frame, wherein each stage includes:

first gating circuitry, responsive to the select signal for generating a further select signal to select the respective row of pixels, which further select signal is applied to the next successive stage as the select signal;

second gating circuitry responsive to the further select signal to apply at least selected ones of the plurality of broadcast control signals to the selected row of pixels.

2. A row select circuit according to claim 1, wherein the pixels in the rows of pixels are subject to an autozero operation and a data load operation and the broadcast control signals include: a first control signal which causes the pixels in the selected row of pixels to perform the autozero operation and a second control signal occurring after the first control signal, which causes the selected pixels to perform the data load operation.

3. A row select circuit according to claim 2, wherein the pixels in the rows of pixels are further subject to a reset operation, occurring before the autozero operation and wherein the first gating circuitry applies control signals to the selected row of pixels to reset the selected row of pixels while the first gating circuitry of a prior stage in the plurality of series connected stages is applying one of the autozero and data load control signals to a respective prior row of pixels in the display device.

4. A row select circuit according to claim 3, wherein stage in which the reset signal is applied immediately follows the stage in which the one of the autozero and data load control signals are applied in the plurality of series connected stages.

5. A row select circuit according to claim 3, wherein stage in which the reset signal is applied is separated from the stage in which the one of the autozero and data load control signals are applied by at least one stage in the plurality of series connected stages.

6. A row select circuit according to claim 1 further including:

third gating circuitry, responsive to an array select signal to apply selected ones of the plurality of broadcast control signals to all pixels in all rows in the display device.

7. A row select circuit according to claim 6, wherein the pixels in the rows of pixels are subject to an autozero operation and a data load operation and the broadcast control signals include: a first control signal which causes the pixels in the selected row of pixels to perform the autozero operation while the array select signal selects all pixels in all rows of the display device and a second control signal occurring after the first control signal when the select signal selects individual rows of pixels, which causes the selected individual rows of pixels to perform the data load operation.

8. A row select circuit according to claim 1, wherein the rows of pixels in the display exhibit different characteristics among a plurality of display devices and the broadcast control signals are adapted to achieve optimum performance for each display device.

9. A display device comprising:

a polysilicon substrate;

a plurality of rows of picture elements (pixels), implemented in the polysilicon substrate, each pixel including:

an organic light emitting diode (OLED) display element;

a first transistor configured as a current source, responsive to a control value to provide a controlled current to the OLED display element;

a second transistor coupled to a select signal to store the control value into the pixel when the select signal is active; and a third transistor coupled to an illuminate signal to couple the controlled current to the OLED display element to illuminate the OLED display element when the select signal is not active; and a plurality of broadcast control signals including a broadcast illuminate control signal;

a row select circuit, implemented on the polysilicon substrate, the row select circuit comprising a plurality of stages connected in series, each stage being coupled to a respective one of the rows of pixels to provide the select signal to the respective row of pixels and being coupled to receive the select signal from a previous stage of the series-connected stages as a signal to provide the select signal to the respective row of pixels, wherein the first stage is coupled to receive a select signal at the start of an image frame, wherein each stage includes:

a fourth transistor, responsive to the select signal provided by the previous stage and a clock signal to generate the select signal for the respective row of pixels;

a fifth transistor, responsive to the select signal for the row of pixels and to the broadcast illuminate signal to apply the illuminate control signal to the selected row of pixels.

10. A display device according to claim 9 wherein:

each pixel further includes a sixth transistor coupled to the first transistor and to an autozero control signal to perform an autozero function on the first transistor;

the plurality of broadcast control signals further includes a broadcast autozero signal; and each stage of the row select circuit further includes a seventh transistor, responsive to the select signal for the row of pixels and to the broadcast autozero signal for providing the autozero control signal to the sixth transistor of each pixel in the row of pixels.

11. A display device according to claim 10 wherein:

the broadcast controls signals further include an array select signal;

the row select circuit further includes:

an eighth transistor, responsive to the array select signal to simultaneously apply the broadcast autozero signal to all pixels in all rows in the display device.

* * * * *